US005484196A

United States Patent [19]

Kim

[11] Patent Number: 5,484,196

[45] Date of Patent: Jan. 16, 1996

[54] MEDICINE CABINET WITH RELOCATABLE CANTILEVER SHELVES

[75] Inventor: Young R. Kim, Pomona, Calif.

[73] Assignee: Pacific Precision Metals, Inc., Azusa, Calif.

[21] Appl. No.: 179,066

[22] Filed: Jan. 10, 1994

[51] Int. Cl.[6] ..... A47B 67/02

[52] U.S. Cl. ..... 312/242; 312/408; 211/90; 248/248; 248/222.51

[58] Field of Search ..... 312/242, 408, 312/350; 211/90; 248/248, 222.2

[56] References Cited

U.S. PATENT DOCUMENTS

| | | | |
|---|---|---|---|
| 1,584,575 | 5/1926 | Waelti | 211/90 X |
| 2,178,511 | 10/1939 | Kucher . | |
| 2,691,502 | 10/1954 | Jones . | |
| 2,787,382 | 4/1957 | Williams . | |
| 2,958,427 | 11/1960 | Bianchi | 211/148 |
| 2,971,805 | 2/1961 | Weiss . | |
| 3,511,193 | 5/1970 | Schild . | |
| 3,791,402 | 2/1974 | Shuler . | |
| 3,993,002 | 11/1976 | Stroh . | |
| 4,174,486 | 11/1979 | Winkler . | |
| 4,205,815 | 6/1980 | Sauer et al. . | |
| 4,319,792 | 3/1982 | Britt et al. | 312/350 X |
| 4,365,562 | 12/1982 | Webb . | |
| 4,641,462 | 2/1987 | Markus . | |
| 4,680,829 | 7/1987 | Baumgarten . | |
| 4,876,766 | 10/1989 | Cohen . | |
| 4,878,156 | 10/1989 | Hallings et al. . | |
| 4,972,545 | 11/1990 | Ozagir et al. . | |
| 5,004,302 | 4/1991 | Stocking et al. | 312/408 |
| 5,025,826 | 6/1991 | Schoepe et al. . | |
| 5,084,940 | 2/1992 | Loffler et al. . | |
| 5,138,803 | 8/1992 | Grossen . | |
| 5,139,322 | 8/1992 | Aisley . | |
| 5,255,971 | 10/1993 | Aisley . | |
| 5,335,797 | 8/1994 | Myers | 211/90 X |
| 5,405,196 | 4/1995 | Shoup et al. | 312/350 X |

FOREIGN PATENT DOCUMENTS

| | | | |
|---|---|---|---|
| 1379535 | 10/1964 | France | 312/408 |
| 2364415 | 7/1975 | Germany | 248/248 |

OTHER PUBLICATIONS

"Jensen—A Nortek Company"—(2) Catalogue pages—publishd prior to Oct. 29, 1992.

*Primary Examiner*—Peter M. Cuomo
*Assistant Examiner*—David E. Allred
*Attorney, Agent, or Firm*—Brown, Martin, Haller & McClain

[57] ABSTRACT

Shelves that have a length less than the full width of the interior of a medicine cabinet housing may be relocated in housing to accommodate articles of different sizes. The housing has horizontal slots along its side walls and vertical slots on its rear wall. Each shelf fits between a side wall and a vertical slot. One end of each shelf has a tab for engaging the horizontal slots, and the other end has a hook for engaging the vertical slots. Two shelves may be installed in a side-by-side configuration to provide a surface that has a length approximately equal to the full width of the interior of the housing by engaging their hooks in the same vertical slot.

29 Claims, 2 Drawing Sheets

MEDICINE CABINET WITH RELOCATABLE CANTILEVER SHELVES

BACKGROUND OF THE INVENTION

The present invention relates generally to medicine cabinets and, more specifically, to a medicine cabinet having shelves that are less than the full width of the cabinet and that are completely supported at one end by engaging the rear of the cabinet and at the other end by engaging the side of the cabinet.

Medicine cabinets of the type used in bathrooms of residential dwellings for storing articles such as medicines and personal hygiene products typically have a rectangular pan-shaped housing with a hinged door. The door may have a mirror, and the cabinet may be mounted in a recessed manner in the bathroom wall. The interior of the housing typically has multiple shelves. In some conventional medicine cabinets the shelves may be moved or adjusted to multiple vertical positions to accommodate articles of different sizes.

Practitioners in the art have addressed the problem of maximizing storage in a medicine cabinet when articles of different sizes are stored. In a conventional medicine cabinet, the vertical distance between shelves must be adjusted to accommodate the tallest article placed on the lower shelf. Thus, the space above shorter articles is wasted, particularly if only a very small number of articles are taller than the other articles. Often, it is difficult or inconvenient to group articles of a particular height together on a shelf. For these reasons practitioners have developed medicine cabinets that have shelves extending across the cabinet only a fraction of the cabinet width, such as one-half. A shorter article on one side of the cabinet may thus be placed adjacent a taller article on the other side of the cabinet, and a half-width shelf may be placed directly above the shorter article.

U.S. Pat. No. 5,139,322, issued to Aisley, discloses a medicine cabinet that has half-width shelves, which are movable among a plurality of vertical positions. A central support bracket disposed vertically in the cabinet and formed integrally with the rear wall of the cabinet engages and supports one end of each half-width shelf. A side wall of the cabinet engages and supports the other end. Although such an arrangement increases storage space, it lacks flexibility because the central bracket is immovable and of a predetermined length.

A medicine cabinet manufactured by Jensen General Corp. has half-width shelves that are movable among a plurality of vertical positions. A post supports one end of each shelf in the middle of the cabinet, and a side wall of the cabinet supports the other end. The post has a snap-type connector that engages one of a plurality of holes arrayed vertically down the middle of the rear wall. The post also has two diametrically opposing grooves along its length. A horizontal surface extending the full width of the cabinet may be formed by inserting one shelf between one groove and one side wall and another shelf between the other groove and the other side wall. Such a cabinet is not economical to manufacture because it comprises several different parts. Moreover, seating a post in the rear wall of the cabinet and then seating two shelves between the post and the side walls is an inconvenient procedure because it involves two separate steps and three separate parts. In addition, a user must be careful to ensure that the ends of the shelves are properly seated in the post before placing articles on the shelves.

A medicine cabinet that has movable shelves that extend less than the full width of the cabinet, is economical to manufacture, and is simple and convenient to use is needed. These problems and deficiencies are clearly felt in the art and are solved by the present invention in the manner described below.

SUMMARY OF THE INVENTION

The present invention comprises a substantially rectangular pan-shaped housing, a door, and a plurality of shelves on which articles may be supported. The shelves may be relocated to a plurality of positions in the interior of the housing to accommodate articles of different sizes.

The housing comprises an upper wall, a lower wall, two side walls, and a rear wall. A door, which may have a mirrored exterior, may be connected to the front of one of the sides of the housing in any suitable manner known in the art. The walls may have any suitable thickness and construction, and features of the present invention described herein with respect to the housing walls should be construed with respect to those portions of the housing walls defining the interior of the housing.

The rear wall has a plurality of vertical slots spaced along a vertical line. Each side wall has a plurality of horizontal slots spaced along it.

The shelves have a length that is a fraction of the length of the upper and lower walls. Each shelf fits between a side wall and a vertical slot. The shelves may have identical lengths or they may have different lengths. One end of each shelf has a tab for engaging the horizontal slots, and the other end has a hook for engaging the vertical slots. Each shelf provides a planar horizontal surface for supporting articles when its tab is engaged in a horizontal slot and its hook is engaged in a vertical slot.

Shelves may be located in the housing to provide a surface for supporting articles that extends either the entire length of the upper and lower walls or only a fraction of that length. A surface extending the former distance may be provided by locating two shelves adjacent one another at the same elevation in the housing with the hooks of the two shelves engaging the same vertical slot. A surface extending the latter distance may be provided by locating only one shelf at a given elevation in the housing.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF THE PREFERRED EMBODIMENT

Figure 1:
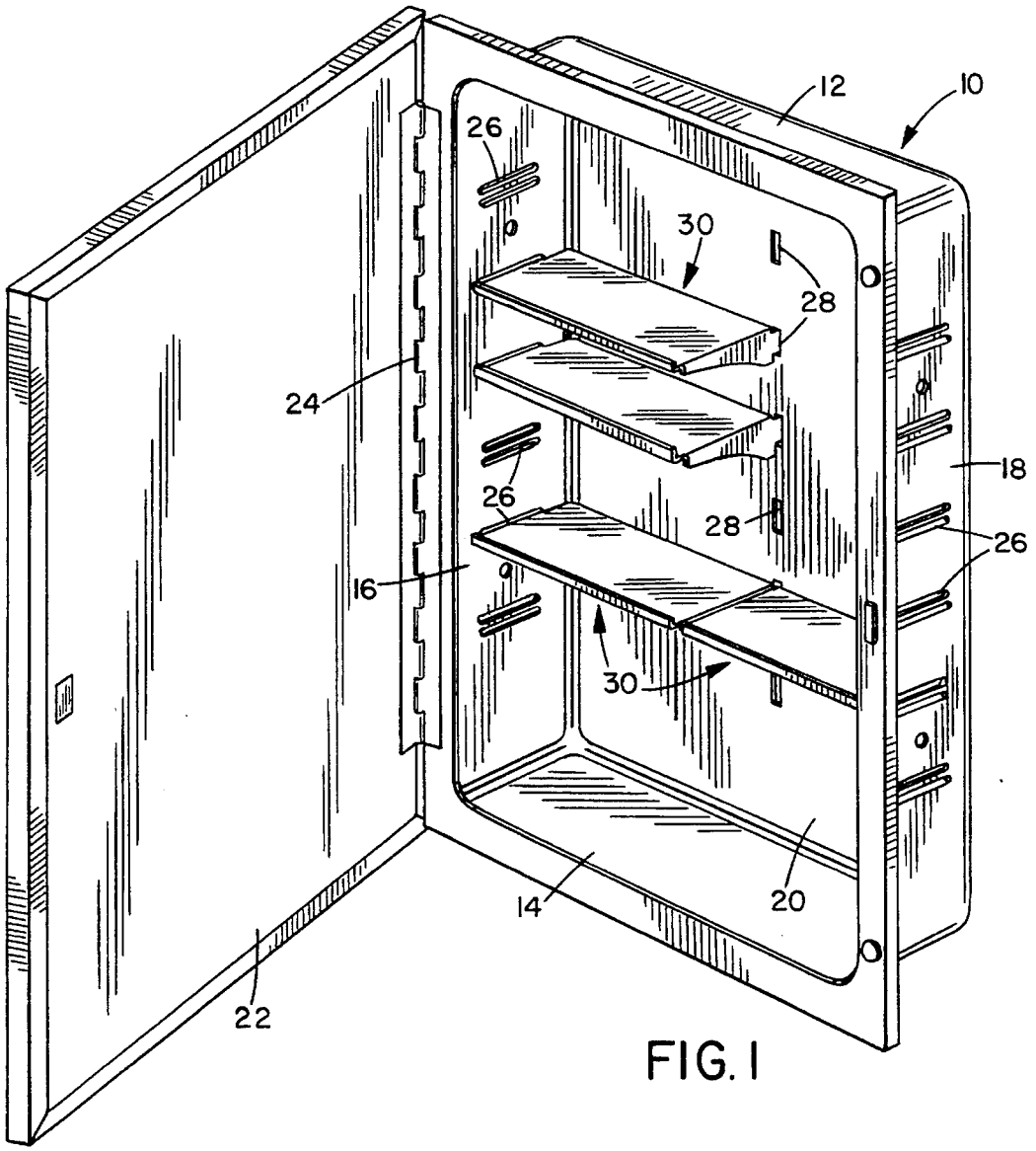
FIG. 1 is a perspective view of a typical medicine cabinet with several shelves in place.

As illustrated in FIG. 1, the present invention comprises a housing 10 that may be mounted in an opening in the wall of a dwelling (not shown). Housing 10 has a top wall 12, a bottom wall 14, two side walls 16 and 18, and a rear wall 20. A mirrored door 22 is attached with a hinge 24 to the forward portion of side wall 16. As will be recognized by persons of skill in the art, the assembly consisting of housing 10 and door 22 is vertically symmetric and may be mounted in a wall with door 22 either to the left or right of housing 10. Each of side walls 16 and 18 has a plurality of horizontal slots 26 spaced along its length. Rear wall 20 has a plurality of vertical slots 28 spaced along a vertical axis bisecting rear wall 20 into left and right halves. Although other materials may be suitable, housing 10 is preferably made of sheet metal.

Figure 3:
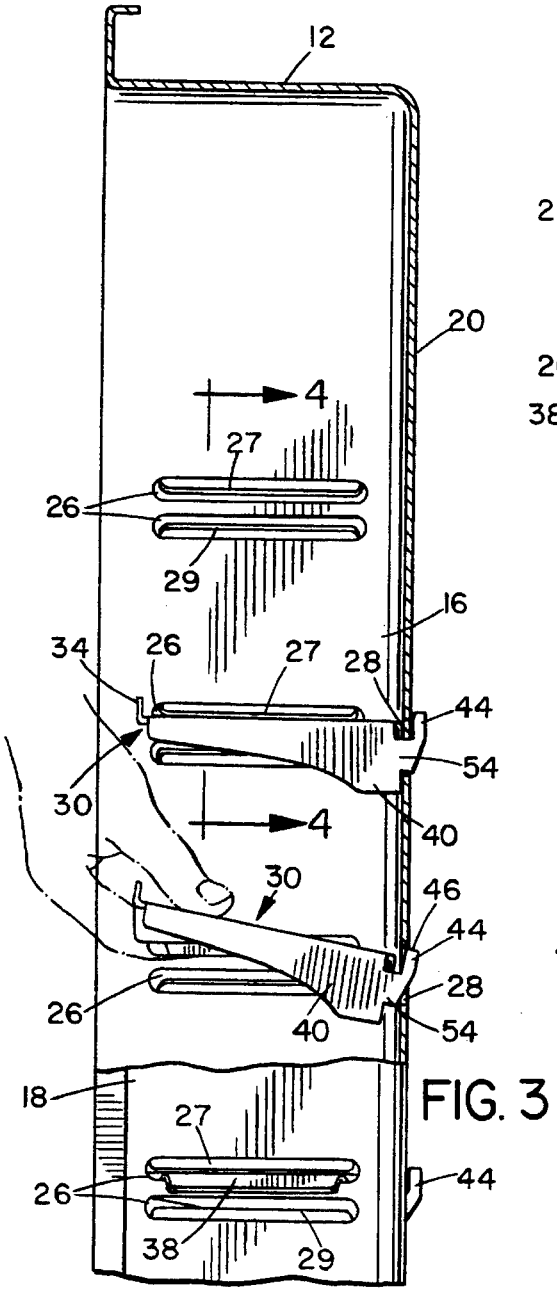
FIG. 3 is a side elevation view, partially cut away, showing insertion of a shelf.
Figure 4:
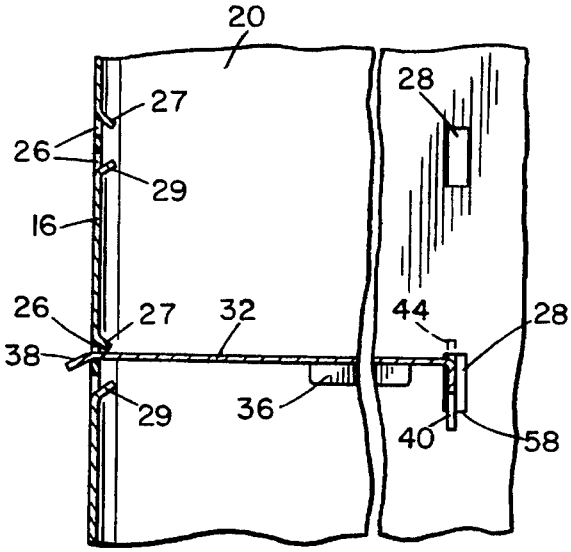
FIG. 4 is a sectional view taken along line 3—3 of FIG. 3.
Figure 5:
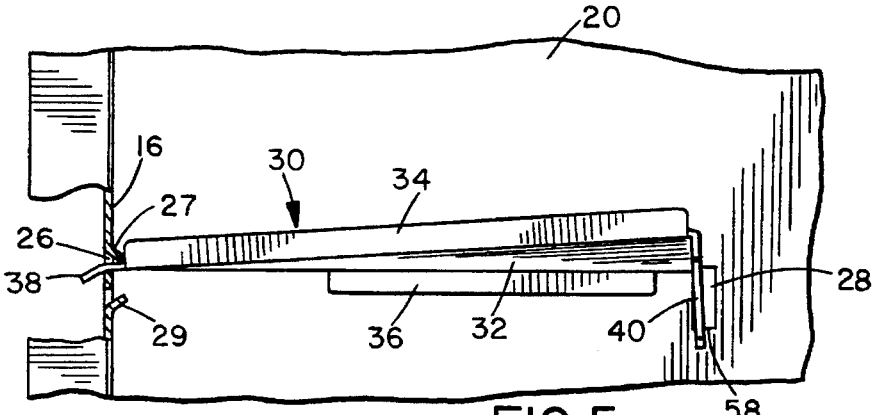
FIG. 5 is front view showing flexing of a shelf during insertion.

As shown best in FIGS. 3–5, horizontal slots 26 may comprise a plurality of paired openings defined by inward protrusions 27 and 29 of a type commonly used to provide mounting slots for glass shelves (not shown) or other shelves commonly used in the art. Although pairing of horizontal slots 26 is not required by the present invention, it is important to note that the present invention can be used to provide a novel relocatable shelf arrangement in existing medicine cabinets that are designed to receive glass or similar shelves.

Figure 2:
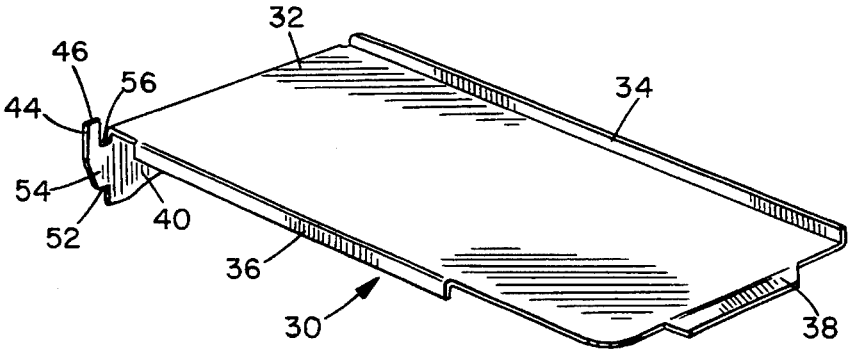
FIG. 2 is an enlarged perspective view of one shelf.

As illustrated in FIG. 2, the present invention further comprises a plurality of shelves 30 that may be installed in housing 10. Each shelf 30 is preferably approximately as long as the distance between the axis along which vertical slots 28 are spaced and one of side walls 16 and 18. Each shelf 30 is preferably approximately as wide as the distance between rear wall 20 and the forward portion of housing 10. Each shelf 30 has a flat surface 32 for supporting articles, a lip 34 at a forward edge for preventing articles from slipping over the forward edge, a brace 36 at a rearward edge, a tab 38 at a first end, and a cantilever support 40 at a second end. Cantilever support 40 has a hook 42 at the rearward edge of shelf 30. Although other materials may be suitable, shelves 30 are preferably made of sheet metal.

Lip 34, brace 36, tab 38, and cantilever support 40 are all preferably integrally formed with surface 32. Lip 34, brace 36, and cantilever support 40 may be formed by bending the sheet metal of shelf 30 at an angle of 90° with respect to surface 32. Tab 38 may also be angled with respect to surface 32. Hook 42 is preferably integrally formed with cantilever support 42 and may be an extension of the sheet metal of cantilever support 42 coplanar with cantilever support 42.

A shelf 30 may be installed in housing 10 by engaging tab 38 in one of horizontal slots 26 and engaging hook 42 in one of vertical slots 28. Horizontal slots 26 and vertical slots 28 are arranged at suitable elevations in housing 10 to support shelf 30 in a horizontal orientation when it is installed. Two shelves 30 may be installed in a side-by-side configuration at the same elevation in housing 10 by engaging their respective hooks 42 in the same vertical slot 28. Hooks 42 preferably have a thickness less than or equal to one half the width of vertical slot 28 to facilitate installation of two shelves 30 in the side-by-side configuration.

The plurality of shelves 30 consists of a plurality of shelves 30 having a left-hand orientation for installation on the left side of housing 10 and a plurality of shelves 30 having a right-hand orientation for installation on the right side of housing 10. Shelves 30 having a left-hand orientation have tab 38 on the left side of surface 32 and cantilever support 40 on the right side of surface 32, and shelves 30 having a right-hand orientation have tab 38 on the right side of surface 32 and cantilever support 40 on the left side of surface 32.

Figure 6:
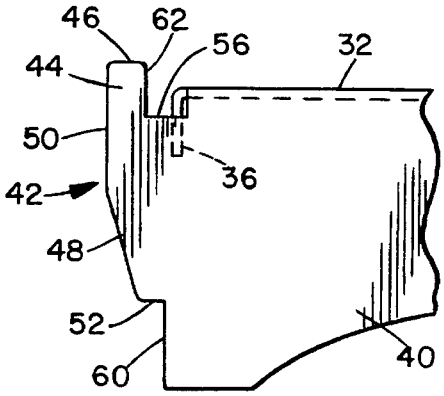
FIG. 6 is an enlarged side view of a shelf showing the hook.

To describe installation of a shelf 30 in housing 10 in further detail, reference is made to FIGS. 3–6. Tab 38 is first inserted into one of horizontal slots 26. If horizontal slots 26 comprise paired openings, tab 38 may be inserted into either opening but is preferably inserted into the upper opening, as shown. The long portion 44 of hook 42, which is defined between a hook bottom edge 52 and a long portion top edge 46, is then inserted into one of vertical slots 28. As it is inserted, the upper edge 46 of long portion 44 is hooked upwardly to urge it completely through to the opposite side of rear wall 20. Long portion 44 is longer than vertical slot 28 and, as shown in FIG. 6, may have a beveled edge 48 extending between hook bottom edge 52 and a long portion rearward edge 50 to facilitate this hooking motion.

When shelf 30 is installed in housing 10, the short portion 54 of hook 42, which is defined between hook bottom edge 52 and a short portion top edge 56, extends through vertical slot 28. The hook bottom edge 52 rests on the vertical slot bottom edge 58 to support shelf 30. A portion of the cantilever support rearward edge 60 contacts rear wall 20, and brace 36 also contacts rear wall 20 to provide additional support and stability to shelf 30. The long portion forward edge 62 abuts the opposite side of rear wall 20 to retain shelf 30 against rear wall 20.

The horizontal slot 26 into which tab 38 is inserted may have a width that is sufficiently greater than the thickness of tab 38 to allow a user to move or rotate shelf 30 with tab 38 extending into slot 26 to an orientation where long portion 44 of hook 42 can be completely inserted through vertical slot 28. However, it is preferred that the horizontal slot 26 into which tab 38 is inserted have a width substantially equal to the thickness of tab 38 such that a minimal clearance exists between them when tab 38 extends into slot 26. Shelf 30 is thus restrained against substantial rotational movement relative to horizontal slot 26. Shelf 30 must therefore flex or twist in response to a torsional force applied by a user in order for long portion 44 of hook 42 to be inserted through vertical slot 28, as shown in FIG. 5. Although it is preferred that the clearance between tabs 38 and horizontal slots 26 be minimized, a combination of flexure and rotation of shelf 30 is also suitable.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A cabinet, comprising:

a housing comprising a first side wall having a forward portion and a rearward portion, a second side wall having a forward portion and a rearward portion, an upper wall having a forward portion and a rearward portion, a lower wall having a forward portion and a rearward portion, and a rear wall adjacent each said rearward portion;

said rear wall having a plurality of narrow vertical slots elongated in the direction of an axis parallel to said side walls, and each said side wall having a plurality of horizontal slots parallel to said upper and lower walls; and a plurality of shelves, each shelf having a forward edge, a rearward edge, a first end, and a second end, the distance between said first and second ends defining a length, said first end having a tab for engaging one of said horizontal slots, said second end having a hook elongated in a direction perpendicular to said forward and rearward edges, said shelf being resiliently deflectable with respect to said first end for engaging said hook in one of said vertical slots, each said vertical slot having a width greater than a combined thickness of two said hooks for engaging one said hook or for engaging two of said hooks simultaneously.

2. The cabinet recited in claim 1, wherein:

each said vertical slot is disposed along an axis bisecting said rear wall; and said length of each said shelf is substantially equal to the distance between said axis and one said side wall.

3. The cabinet recited in claim 1, wherein said shelf has a thickness and said rearward edge of each said shelf has a brace extending perpendicularly away from a planar surface of said shelf by a distance greater than said thickness of said shelf for supporting said shelf against said rear wall.

4. The cabinet recited in claim 3, wherein said brace is unitarily formed with said shelf.

5. The cabinet recited in claim 4, wherein:

each said shelf is made of sheet metal; and said brace comprises a ninety degree (90°) angle in said sheet metal.

6. The cabinet recited in claim 1, wherein said forward edge of each said shelf has a lip.

7. The cabinet recited in claim 6, wherein said lip is unitarily formed with said shelf.

8. The cabinet recited in claim 7, wherein:

each said shelf is made of sheet metal; and said lip comprises a ninety degree (90°) angle in said sheet metal.

9. The cabinet recited in claim 1, wherein said shelf has a thickness and said second end of each said shelf has a gusset-shaped cantilever support extending between said forward and rearward edges and having at least a portion extending perpendicularly away from a planar surface of said shelf by a distance at least three times said thickness of said shelf.

10. The cabinet recited in claim 9, wherein said cantilever support is unitarily formed with said shelf.

11. The cabinet recited in claim 10, wherein:

each said shelf is made of sheet metal; and said cantilever support comprises a ninety degree (90°) angle in said sheet metal.

12. The cabinet recited in claim 10, wherein:

each said shelf is made of sheet metal;

said hook comprises a coplanar extension of said sheet metal of said cantilever support;

said hook has a short portion adjacent said rearward edge of said shelf and a long portion extending therefrom; and said short portion extends through said vertical slot with said long portion on an opposite side of said rear wall from said shelf when said hook is disposed in engagement with said vertical slot and said tab is disposed in engagement With said horizontal slot, said long portion is longer than said vertical slot through which said short portion extends.

13. The cabinet recited in claim 12, wherein each said vertical slot is disposed at a distance from each said side wall equal to said length of each said shelf.

14. The cabinet recited in claim 12, wherein said hook is engaged in said vertical slot by flexing said shelf in response to a torsional force while said tab of said shelf contacts one said horizontal slot to prevent vertical movement of said first end of said shelf.

15. A cabinet, comprising:

a housing comprising a first side wall having a forward portion and a rearward portion, a second side wall having a forward portion and a rearward portion, an upper wall having a forward portion and a rearward portion, a lower wall having a forward portion and a rearward portion, and a rear wall adjacent each said rearward portion;

said upper and lower walls having a length, said rear wall having a plurality of narrow vertical slots elongated in the direction of an axis parallel to said side walls, and each said side wall having a plurality of horizontal slots parallel to said upper and lower walls, each said vertical slot disposed at a distance from each said side wall equal to one-half said length of said upper and lower walls;

a plurality of shelves, each shelf having a thickness and a planar surface, a forward edge, a rearward edge, a first end, and a second end, the distance between said first and second ends defining a length, said first end having a tab for engaging one of said horizontal slots, said second end having a hook elongated in a direction perpendicular to said forward and rearward edges, said shelf being resiliently deflectable with respect to said first end for engaging said hook in one of said vertical slots; and said second end of each said shelf having a gusset-shaped cantilever support extending between said forward and rearward edges and extending perpendicularly away from a planar surface of said shelf by a distance at least three times said thickness of said shelf.

16. The cabinet recited in claim 15, wherein said forward edge of each said shelf has a lip.

17. The cabinet recited in claim 15, wherein:

said hook comprises a coplanar extension of said cantilever support, said extension having a short portion adjacent said rearward edge of said shelf and a long portion extending therefrom;

said short portion has a length defined between a short portion top edge and a short portion bottom edge;

said long portion has a length defined between a long portion top edge and a long portion bottom edge said vertical slot has a length defined between a vertical slot top edge and a vertical slot bottom edge;

said length of said vertical slot is greater than or equal to said length of said short portion and less than said length of said long portion; and said short portion extends through said vertical slot with said long portion on an opposite side of said rear wall from said shelf when said hook engages said vertical slot.

18. The cabinet recited in claim 17, wherein said short portion bottom edge at least partially contacts said vertical slot bottom edge when said hook engages said vertical slot.

19. The cabinet recited in claim 18, wherein said short portion top edge is below said planar surface of said shelf.

20. The cabinet recited in claim 18, wherein said long portion bottom edge is collinear with said short portion bottom edge.

21. The cabinet recited in claim 20, wherein:

said long portion has a forward edge and a rearward edge; and said long portion has a beveled edge extending between said long portion bottom edge and said long portion rearward edge.

22. The cabinet recited in claim 21, wherein said long portion forward edge at least partially contacts said vertical slot top edge when said hook engages said vertical slot.

23. The cabinet recited in claim 22, wherein said hook is engaged in said vertical slot by flexing said shelf in response to a torsional force while said tab of said shelf contacts one said horizontal slot to prevent vertical movement of said first end of said shelf.

24. The cabinet recited in claim 23, wherein said cantilever support of each said shelf are integrally formed with said shelf.

25. The cabinet recited in claim 24, wherein each said shelf is made of sheet metal.

26. The cabinet recited in claim 25, wherein said cantilever support comprises a ninety degree (90°) angle in said sheet metal.

27. A cabinet, comprising:

a housing comprising a left side wall having a forward portion and a rearward portion, a right side wall having a forward portion and a rearward portion, an upper wall having a forward portion and a rearward portion, a lower wall having a forward portion and a rearward portion, and a rear wall adjacent each said rearward portion;

said rear wall having a plurality of narrow vertical slots elongated in the direction of an axis parallel to said side walls, and each said side wall having a plurality of horizontal slots parallel to said upper and lower walls; and a plurality of left-hand shelves, each shelf having a forward edge, a rearward edge, a left end, and a right end, the distance between said ends defining a length, said left end having a unitarily formed tab for engaging one of said horizontal slots of said left side wall, said right end having a unitarily formed hook elongated in a direction perpendicular to said forward and rearward edges, said left-hand shelf being resiliently deflectable with respect to said left end for engaging said hook in one of said vertical slots;

a plurality of right-hand shelves, each shelf having a forward edge, a rearward edge, a left end, and a right end, the distance between said ends defining a length, said right end having a unitarily formed tab for engaging one of said horizontal slots of said right side wall, said left end having a unitarily formed hook elongated in a direction perpendicular to said forward and rearward edges, said right-hand shelf being deflectable with respect to said right end for engaging said hook in one of said vertical slots; and the sum of the lengths of one said left-hand shelf and one said right-hand shelf is substantially equal to the distance between said left and right walls.

28. The cabinet recited in claim 27, wherein said lengths of said one said left-hand shelf and said one said right-hand shelf are equal.

29. The cabinet recited in claim 28, wherein said lengths of all said shelves are equal.

* * * * *